US005526959A

United States Patent [19]

Green

[11] Patent Number: 5,526,959

[45] Date of Patent: Jun. 18, 1996

[54] SOFT DRINK DISPENSING HEAD

[75] Inventor: Thomas S. Green, Atwater, Ohio

[73] Assignee: ABC TechCorp., Akron, Ohio

[21] Appl. No.: 352,530

[22] Filed: Dec. 9, 1994

[51] Int. Cl.[6] ..... B67D 5/56

[52] U.S. Cl. ..... 222/129.4; 222/145.1; 239/424.5; 239/433; 239/553.3

[58] Field of Search ..... 239/418, 424.5, 239/433, 553.3, 553.5; 222/129.1, 129.3, 129.4, 145.1

[56] References Cited

U.S. PATENT DOCUMENTS

| | | | |
|---|---|---|---|
| 2,493,660 | 1/1950 | Elkins | 222/129.3 X |
| 4,266,726 | 5/1981 | Brown et al. | 222/129.1 X |
| 4,270,673 | 6/1981 | Rodth | 222/129.1 X |
| 4,392,588 | 7/1983 | Scalera | 222/129.4 |
| 4,821,925 | 4/1989 | Wiley et al. | 222/129.4 |
| 4,953,751 | 9/1990 | Shannon | 222/129.4 X |
| 5,033,651 | 7/1991 | Whigham et al. | 222/129.1 X |
| 5,048,726 | 9/1991 | McCann et al. | 222/129.1 |
| 5,186,363 | 2/1993 | Haynes | 222/129.1 X |
| 5,203,474 | 4/1993 | Haynes | 222/129.1 |
| 5,269,442 | 12/1993 | Vogel | 222/129.1 |

FOREIGN PATENT DOCUMENTS

| | | | |
|---|---|---|---|
| 2256636 | 12/1992 | United Kingdom | 222/145.1 |
| 2269761 | 2/1994 | United Kingdom | 222/129.1 |

*Primary Examiner*—Andres Kashnikow
*Assistant Examiner*—Kenneth Bomberg
*Attorney, Agent, or Firm*—Renner, Kenner, Greive, Bobak, Taylor & Weber

[57] ABSTRACT

A soft drink dispensing head capable of rapidly dispensing soft drinks with minimized foaming action includes a housing connected to a source of soda and a source of syrup, a diffuser within the housing, and a plurality of passages disposed below the diffuser. The source of soda delivers a supply of soda to the diffuser which causes the direction of the soda flow to be changed 180 degrees. The soda then falls over the diffuser and through a plurality of dispensing passages exiting the housing in a free falling stream. The soda and syrup are dispensed separate from each other and allowed to mix external to the dispensing head but before colliding with a cup located beneath the dispensing head. The source of syrup is in fluid communication with a groove that encircles a portion of the housing. A plurality of syrup dispensing ducts are in fluid communication with the groove and are configured such that each centerline of each duct intersects the free falling stream of soda. When the source of syrup delivers syrup to the groove, the syrup is forced out of the ducts and into the free falling stream of soda.

12 Claims, 1 Drawing Sheet

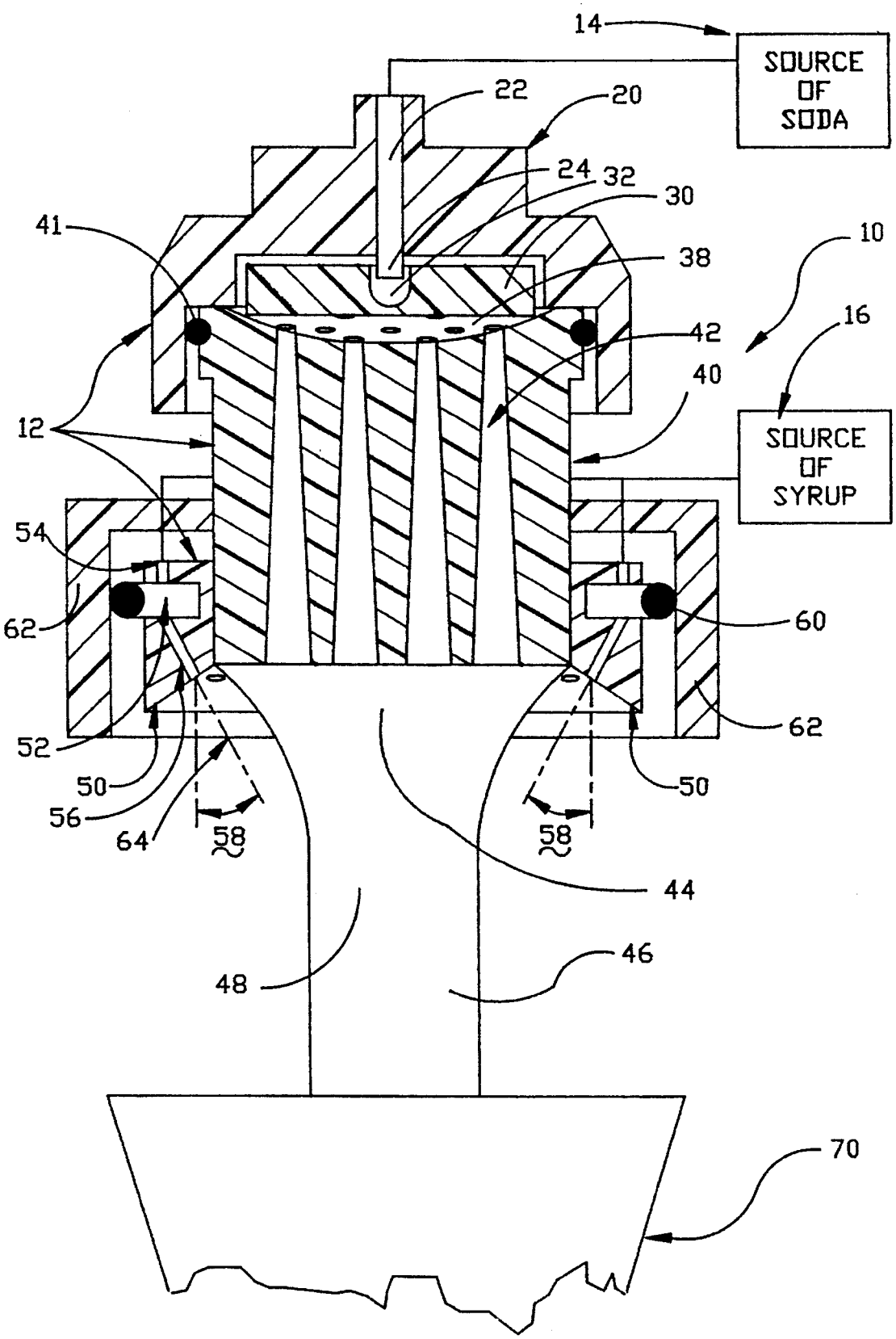
14
SOURCE OF SODA
22
20
24
32
30
41
38
10
42
16
40
12
SOURCE OF SYRUP
54
62
60
62
52
50
50
56
64
58
58
44
48
46
70

SOFT DRINK DISPENSING HEAD

TECHNICAL FIELD

The invention herein relates to the art of beverage dispensers and, more particularly, to a soft drink dispensing head that mixes soda or carbonated water with syrup external to the dispensing head.

BACKGROUND ART

The food service industry serves numerous, freshly mixed soft drinks to customers each day. For various reasons, the industry desires to create the soft drinks for the customer after the customer places an order for the drink. To create the soft drinks, the server mixes soda or carbonated water (hereinafter referred to as soda) with the flavoring syrup of the customer's choice. The industry desires to create drinks in this manner as fast as possible while maintaining the highest quality product.

In order to create a soft drink quickly, the required volumes of soda and syrup must be dispensed into the target container at a high flow rate. Dispensing soda at a high flow rate often leads to foaming. Soda is generally effervescent when not under pressure. The presence of effervescence in soft drinks is desirable when the soft drink is served to the customer. A soft drink that lacks effervescence is commonly referred to as being a "flat" drink. Effervescence is caused by gas escaping from the soda and is increased by agitating the soda. A major problem, therefore, with dispensing soda quickly is controlling rapid effervescence because rapid effervescence causes foam. Foam is undesirable to the soft drink creation process because the server must wait until the foam recedes until filling the remaining section of the target container. Foam is also undesirable because foaming results in soft drinks that are "flat". Foaming also causes spills that make the outside of the target container wet and increase clean-up time.

To reduce foaming problems, the soda is dispensed in a "soft" flow. A "soft" flow is one that is as undisturbed as possible, thus minimizing the agitation that increases effervescence. Preferably, the soda flow is only accelerated by the force of gravity as it falls into the target container.

A problem with creating a soft drink using a "soft" flow of soda occurs when the syrup is mixed with the soda. The degree of mixing generally increases with increased agitation. But for the reasons described above, soda cannot be agitated without causing foaming. Thus, another major problem with quickly creating a soft drink is adequately mixing the syrup with the soda without causing foaming. An inadequately mixed soft drink contains sweet spots where the syrup concentration is higher and than in other areas of the drink. This is typically referred to as stratification of the soft drink.

Numerous types of soft drink dispensing heads are known to the art. One type of dispensing head teaches that the syrup and soda be mixed in the dispensing head by means of a mechanical diffuser and then dropped into the target container. Soft drink dispensers of this nature have been typically slow in operation due to the foaming action which results when the syrup and soda are mixed, particularly at fast flow rates. The joining of the syrup with the soda within the dispensing head causes foam to be generated in the head itself such that foam rather than liquid is dispensed. As a result, dispensing the drink must be done in steps with intermittent pauses introduced by the operator to allow the foam to settle. Such pauses delay the dispensing operation and, in a fast service environment, become extremely costly.

Another known beverage dispensing head operates to reduce foaming by dispensing a "soft" flow of soda separate from a stream of syrup. The soda and the syrup mix when they collide with ice normally present in the target container. Such an operation reduces foaming because the soda is not agitated until it reaches the target container. Furthermore, it is well known in the art that foaming decreases as temperature decreases. Thus, the ice in the target container also serves to decrease foaming. Another technique which may be employed to reduce foaming is to dispense the syrup at a low temperature, thus slowing the mixing time with the soda. Although foaming is reduced, thorough mixing is often not achieved with such dispensing techniques.

DISCLOSURE OF INVENTION

Therefore, a first aspect of the present invention is to provide a soft drink dispensing head that rapidly creates a soft drink while reducing foaming and providing a uniform concentration of syrup and soda in the resulting soft drink.

Another aspect of the present invention is to provide a soft drink dispensing head that may be adapted for use with a variety of conventional soft drink dispensing systems.

A further aspect of the present invention is to provide a soft drink dispensing head that dispenses a "soft" flow of soda.

Yet another aspect of the present invention is to provide such a dispensing head that dispenses streams of syrup that intersect the soda flow external to the dispensing head.

Another aspect of the present invention is to provide a soft drink dispensing head wherein a pressurize flow of soda is converted to a "soft" flow of soda by a plurality of diffusers.

A further aspect of the present invention is to provide such a dispensing head that injects syrup into the soda flow external to the dispensing head by providing a ring surrounding the soda flow having a plurality of syrup dispensing ducts.

Yet an additional aspect of the invention is to provide a soft drink dispensing head for dispensing cold syrup, thus slowing the mixing of the soda and syrup, resulting in reduced foaming action.

In general, the present invention contemplates a housing, a source of soda interconnected with the housing, a source of syrup interconnected with the housing, first means within the housing for dispensing a free-falling stream of soda and second means within the housing for introducing syrup into the free-falling stream of soda external to the housing.

DESCRIPTION OF THE DRAWING

For a complete understanding of the objects, techniques and structures of the invention, reference should be made to the following detailed description and accompanying drawing wherein there is shown a sectional view of the soft drink dispensing head.

BEST MODE FOR CARRYING OUT THE INVENTION

Referring now to the drawings, it can be seen that a soft drink dispensing head according to the invention is designated generally by the numeral 10. The soft drink dispensing head 10 includes a housing 12, a source of soda 14 interconnected to the housing 12 and a source of syrup 16 also interconnected to the housing 12. The housing 12 comprises a neck section 40 that engages both a cap section 20 and a ring section 50. The cap section 20 has a soda delivery channel 22 that extends through the cap section 20 and extends beyond the surface of the cap section 20. The soda delivery channel 22 communicates with the source of soda 14. The cap section 20 engages the neck section 40 to enclose a diffuser 30. The diffuser 30 has a cavity 32 that is disposed such that it surrounds the extended portion of the soda delivery channel 22. When soda is delivered downwardly through the soda delivery channel 22 and into the bottom of the cavity 32, the cavity 32 acts to change the direction of the soda flow approximately 180°. The soda then rises up and falls downwardly over the diffuser 30 and onto the top surface of the neck section 40 which is dished or cup-shaped as shown at 38. The connection between the neck section 40 and the cap section 20 is sealed by an O-ring 41 that prevents soda from escaping to outside of the housing 12.

The neck section 40 has a plurality of soda dispensing channels 42 that extend from the top surface of the neck section 40 to the bottom surface of the neck section 40. The soda dispensing passages 42 are substantially tangential at the surface of said neck section 40 where said soda dispensing passages 42 exit. Each soda dispensing passage 42 is conical as it passes through said neck section 40 and is of increasing diameter in a direction of soda flow. After the soda flow falls over the diffuser 30 it enters the plurality of soda dispensing passages 42 and falls through the neck section 40 in a free fall. The velocity of the soda decreases as it falls through the neck section 40 because of the conical shape of the soda dispensing passages 42. As the soda exits the neck section 40 the stream 44 is generally conical and thereafter becomes cylindrical as shown at 46 as it falls into the target container 70.

The ring section 50 comprises a plurality of syrup delivery channels 54 and a plurality of syrup dispensing ducts 56. The ring section 50 has a continuous U-shaped groove 52 extending around the perimeter of said ring section 50. The groove 52 connects each syrup delivery channel 54 with each syrup dispensing duct 56. The syrup delivery channels 54 are in communication with the source of syrup 16. Thus, when syrup is pumped through the syrup delivery channels 54, the groove 52 and, thereafter, the syrup dispensing ducts 56 are filled with syrup. The syrup dispensing ducts 56 are uniformly, circumferentially distributed about the ring section 50. The syrup dispensing ducts 56 are disposed at an angle 58 that is between 14° and 40°, and preferably 27°, from vertical. The syrup dispensing ducts 56 are angled such that the center line of each syrup dispensing duct 56 intersects the free-falling soda stream 48 beneath said neck section 40. The U-shaped groove 52 is sealed by an O-ring 60 that extends around the perimeter of the groove 52. The thickness of the O-ring 60 is larger than the height of the groove 52. A ring 62 is disposed about the neck section 40 and in engagement with the O-ring 60 such that the O-ring 60 effectively seals the U-shaped groove 52 such that syrup may not exit said U-shaped groove 52 except through the syrup dispensing ducts 56. Typically, the ring 62 would be threadedly received by the neck section 40. Thus, when syrup is pumped into the U-shaped groove 52 from the syrup delivery channels 54, the syrup is ejected through the plurality of syrup dispensing ducts 56 with force sufficient to enter the free-falling soda stream 48 before entering the target container 70.

When the server desires to create a soft drink, the source of soda 14 is activated such that a pressurized flow of soda is delivered to the soda delivery channel 22 in the cap section 20. The soda falls downwardly through the soda delivery channel 22 and enters the cavity 32 in the diffuser 30. The cavity 32 is wider than the soda delivery channel 22 so that the velocity of the soda is decreased as it flows up and then out of the cavity 32. The soda then flows outwardly and over the diffuser 30 and falls downwardly to the top surface of the neck section 40 which is dished or cup-shaped, as shown at 38.

The soda then enters and falls downwardly through the plurality of soda dispensing passages 42. The velocity of the soda decreases as it passes through these passages 42 because their cross-sectional areas increase in the direction of soda flow. When the soda exits the soda dispensing passages 42, the soda is free-falling.

The source of syrup 16 is activated at a predetermined time in relation to when the source of soda 14 is activated. Pressurized syrup is delivered to the syrup delivery channels 54 and subsequently fills the U-shaped groove 52. The syrup is then forced out of the U-shaped groove 52 through the syrup dispensing ducts 56 with velocity sufficient to enter the free-falling stream of soda 48 approximately one inch below the bottom surface of the neck section 40. The exact location of entry depends on a variety of factors including the syrup velocity and the angle 58 of the syrup dispensing ducts 56.

The delivery of the soda and syrup are coordinated so that the soda begins to fall from the neck section 40 just before the syrup is ejected. This configuration provides for maximum mixing of soda and syrup before they collide with the ice in the target container 70 thus minimizing both stratification and foaming.

It can be seen that the objects of the invention have been satisfied by the techniques and apparatus presented hereinabove. While in accordance with the present statutes, only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. A soft drink dispensing head, comprising:

a housing;

a source of soda interconnected with said housing;

a source of syrup interconnected with said housing;

first means within said housing for converting a supply of soda from said source of soda to a free falling stream of soda falling from said housing;

second means within said housing for introducing syrup into said free falling stream of soda external to said housing;

said second means comprising a plurality of syrup dispensing ducts each of said syrup dispensing ducts in fluid communication with said source of syrup;

a center line of each said syrup dispensing duct intersecting the free falling stream of soda; and each said center line is at a 14°–40° angle from vertical.

2. A soft drink dispensing head, comprising:

a housing;

said housing comprising a neck section sealedly engaging a cap section to form a chamber, said neck section being surrounded by a ring section;

said can section having at least one soda delivery channel in fluid connection with said source of soda;

said soda delivery channel extending through said cap section and extending beyond a surface of said cap section where said soda delivery channel exits said cap section;

a source of soda interconnected with said housing;

a source of syrup interconnected with said housing;

first means within said housing for dispensing a free falling stream of soda; and second means within said housing for introducing syrup into said free falling stream of soda external to said housing.

3. A soft drink dispensing head according to claim 2, wherein said first means reduces a dispensing velocity of the soda.

4. A soft drink dispensing head according to claim 2, wherein said cap section in combination with said neck section generally surround said first means.

5. A soft drink dispensing head according to claim 2, wherein said ring section generally surrounds said second means.

6. A soft drink dispensing head, comprising:

a housing;

a source of soda interconnected with said housing;

a source of syrup interconnected with said housing;

first means within said housing for dispensing a free falling stream of soda, said first means comprising a plurality of soda dispensing passages generally disposed below a diffuser;

said diffuser having a cavity disposed such that soda enters the cavity from said housing;

said cavity redirecting the soda approximately 180°; and second means within said housing for introducing syrup into said free falling stream of soda external to said housing.

7. A soft drink dispensing head according to claim 6, wherein said soda dispensing passages are substantially tangential at the surface of the housing where said soda dispensing passages exit.

8. A soft drink dispensing head according to claim 6, wherein said soda dispensing passages dispense a free-falling stream of soda that is conical as it exits said housing and thereafter becomes cylindrical.

9. A soft drink dispensing head, comprising:

a housing;

a source of soda interconnected with said housing;

a source of syrup interconnected with said housing;

first means within said housing for dispensing a free falling stream of soda, said first means comprising a plurality of soda dispensing passages generally disposed below a diffuser;

said soda dispensing passages being conical as they pass through said housing and are of increasing diameter in a direction of soda flow therethrough; and second means within said housing for introducing syrup into said free falling stream of soda external to said housing.

10. A soft drink dispensing head, comprising:

a housing;

a source of soda interconnected with said housing;

a source of syrup interconnected with said housing;

first means within said housing for dispensing a free falling stream of soda; and second means within said housing for introducing syrup into the free falling stream of soda external to said housing, said second means comprising a plurality of syrup dispensing ducts, a plurality of syrup delivery channels in fluid communication with a groove extending around the perimeter of the said housing, said groove in fluid communication with each said syrup dispensing duct.

11. A soft drink dispensing head according to claim 10, wherein each of said syrup delivery channels is in fluid communication with said source of syrup.

12. A soft drink dispensing head according to claim 10, wherein said groove is U-shaped and sealed by an O-ring such that syrup cannot exit said U-shaped groove except through said syrup dispensing ducts.

* * * * *